United States Patent [19]

Mitter

[11] 4,055,119

[45] * Oct. 25, 1977

[54] MEANS FOR MOUNTING AND BIASING A SQUEEGEE

[75] Inventor: Mathias Mitter, Verl-Sende-Mitte, Germany

[73] Assignee: Mitter & Co., Schloss Holte, Germany

[ * ] Notice: The portion of the term of this patent subsequent to Dec. 21, 1993, has been disclaimed.

[21] Appl. No.: 479,948

[22] Filed: June 19, 1974

[30] Foreign Application Priority Data

June 20, 1973 Germany ..... 2331428

[51] Int. Cl.[2] ..... B41F 15/46

[52] U.S. Cl. ..... 101/120

[58] Field of Search ..... 101/119, 120, 116, 121, 101/122, 123, 124; 15/256.5, 256.51, 256.52, 256.53

[56] References Cited

U.S. PATENT DOCUMENTS

| | | | |
|---|---|---|---|
| 1,956,562 | 5/1934 | Coates | 101/120 UX |
| 2,928,340 | 3/1960 | Stein et al. | 101/120 |
| 3,110,919 | 11/1963 | Barnby | 101/123 UX |
| 3,718,086 | 2/1973 | Vertegaal | 101/115 |
| 3,735,730 | 5/1973 | Mitter | 101/120 |
| 3,934,502 | 1/1976 | Marino | 101/119 X |

FOREIGN PATENT DOCUMENTS

| | | | |
|---|---|---|---|
| 1,565,286 | 4/1969 | France | 101/120 |
| 2,006,887 | 1/1970 | France | 101/120 |
| 2,207,935 | 11/1972 | Germany | 101/120 |

*Primary Examiner*—Edgar S. Burr
*Assistant Examiner*—R. E. Suter
*Attorney, Agent, or Firm*—Michael J. Striker

[57] ABSTRACT

A screen printing machine wherein a hollow cylindrical stencil rotates about a stationary but adjustable horizontal header which supplies a liquid and is welded to a carrier for a reciprocable or pivotable holder supporting a blade-like or rod-like squeegee. The latter is biased against the internal surface of the stencil by a deformable tubular cushion which is received in a U-shaped portion of the carrier and is deformed by an elongated extension of the holder which imparts to the cushion a kidney-shaped cross-sectional outline. The cushion can be bonded to the carrier and comprises an elastic hose which is reinforced by one or more textile or metallic layers or a non-elastic hose which is reinforced by one or more layers of elastomeric material.

2 Claims, 11 Drawing Figures

S
F
P
91
3
10
90
I
9
1
G
2
10
3
91
90
9
P
S
F 91b
94
92
93
90
91a
92a
3

91c
91b
3
91
91a
94
92
97
90
92a
93
VI
VI
96
95
97

III
III
3
5
6
R
L
K
41
75
8
4
42
72
71
7

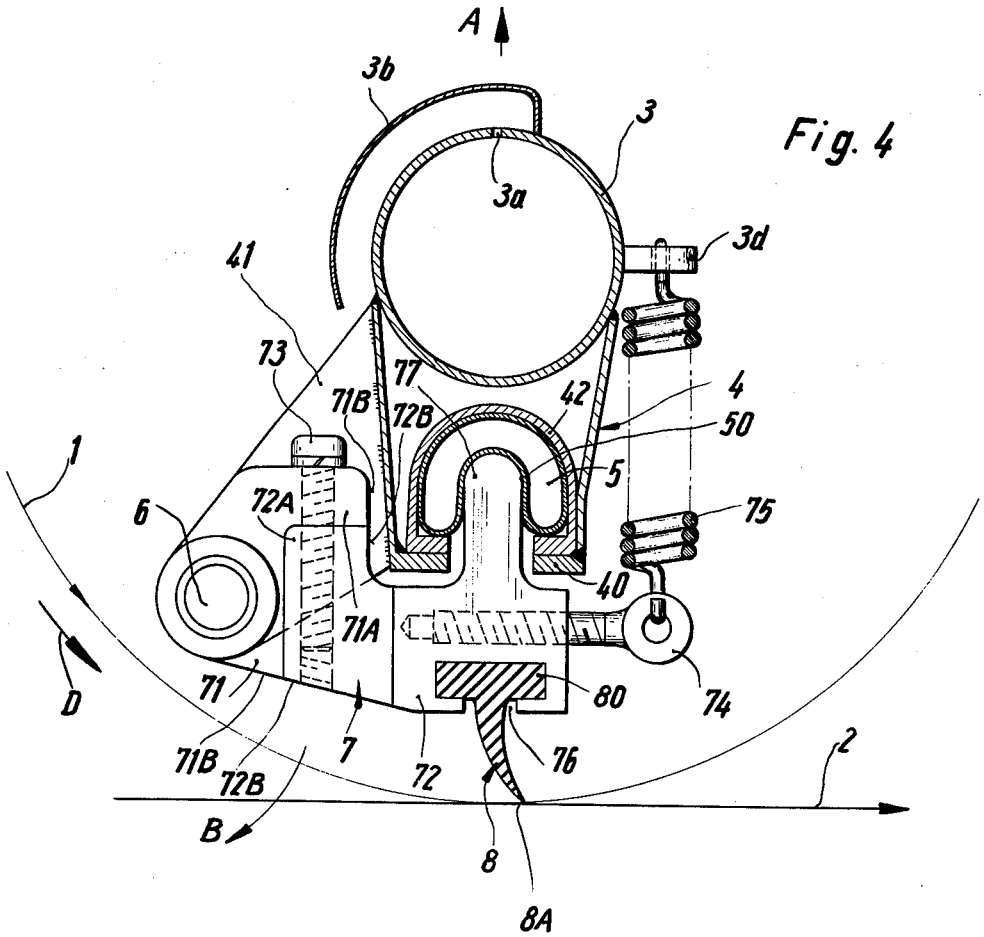
Fig. 4
Fig. 3a
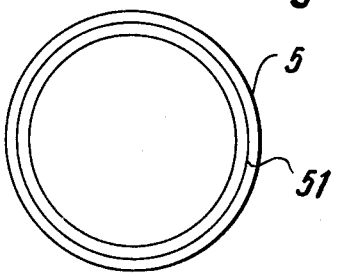

200
10
1a
1
91
S
3
92
93
90
2
209
202
208
204
201
G
9
203
205
207
206

MEANS FOR MOUNTING AND BIASING A SQUEEGEE

BACKGROUND OF THE INVENTION

The present invention relates to screen printing machines in general, and more particularly to improved mounting and biasing means for a squeegee which is installed in the interior of a cylindrical or band-like stencil in a screen printing machine.

It is already known to mount a blade-like or rod-like squeegee in a holder which is biased in a direction toward the internal surface of the stencil by a gas-filled cushion. As a rule, the cushion consists of rubber or rubber-like synthetic plastic material so that it can undergo deformation as well as expansion and contraction. This affects the uniformity of pressure which the cushion transmits to the holder because the length of the cushion changes with changes in the pressure of entrapped fluid. Furthermore, the cushion is subjected to considerable wear because it slides along the adjacent surfaces of the holder and the carrier means whenever it expands or contracts. If the cushion cannot slide relative to the adjacent parts, the pressure in its interior varies due to varying thickness of its wall which also affects the quality of the printing operation, especially as regards the uniformity of pressure with which the squeegee is urged against the internal surface of the stencil.

SUMMARY OF THE INVENTION

An object of the invention is to provide a novel and improved device which biases the holder and the squeegee in a screen printing machine toward the internal surface of a cylindrical or band-like stencil.

Another object of the invention is to provide a device which biases the holder and the squeegee with an accurately reproducible and accurately regulatable force along the full width of the material which is being treated by the stencil.

A further object of the invention is to provide a novel and improved deformable tubular cushion for use as a means for biasing the squeegee against the internal surface of the stencil.

An additional object of the invention is to provide a screen printing or analogous machine which embodies the improved biasing device and to provide the machine with a novel holder for the squeegee and with novel support means for the holder and the biasing device.

Still another object of the invention is to provide a screen printing machine wherein the squeegee is biased against the stencil with an accurately reproducible and regulatable force even if the width of the material is to be treated is in the range of up to and in excess of five meters.

The invention is embodied in a screen printing or like machine which comprises an elongated liquid-permeable stencil having endless internal and external surfaces, means for moving the stencil so as to engage successive increments of the external surface with successive increments of a web of material to be treated, stationary support means in the interior of the stencil, an elongated holder which is movably mounted in the support means, a blade-like or rod-like squeegee which is mounted in the holder, and novel and improved biasing means interposed between the holder and the support means to urge the squeegee against the internal surface of the stencil, preferably at or close to the locus where the external surface of the stencil contacts the web. The biasing means comprises an elongated tubular gas-filled cushion which is deformable but cannot expand or contract. The holder has an elongated extension which bears against and depresses a portion of the cushion; this extension preferably cooperates with a substantially U-shaped portion of the support means to impart to the cushion a substantially kidney-shaped cross-sectional outline. If the stencil is horizontal, the cushion is preferably located above the holder and below the support means so that the extension of the holder depresses the lower portion of the cushion.

The cushion may comprise a hose of elastomeric material and one or more reinforcing layers of steel, another metal and/or fabric which are embedded in the material of the hose. It is also possible to use a flexible but non-stretchable hose and to employ one or more elastomeric reinforcing layers which are embedded in the material of the hose. A portion of the cushion may be glued or otherwise bonded to a portion of the support means.

The novel features which are considered as characteristic of the invention are set forth in particular in the appended claims. The improved screen printing machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3*a* is an end elevational view of the cushion in undeformed condition;

FIG. 4 is an enlarged view of a detail in FIG. 3;

DESCRIPTION OF THE PREFERRED EMBODIMENTS

Figure 1:
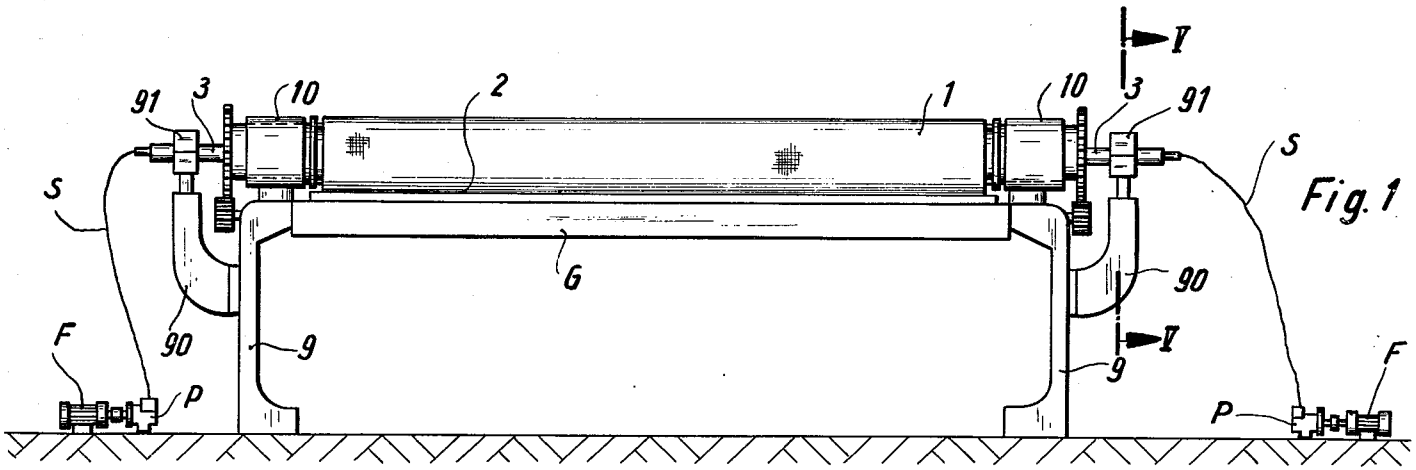
FIG. 1 is a schematic elevational view of a screen printing machine which embodies the invention.
Figure 6:
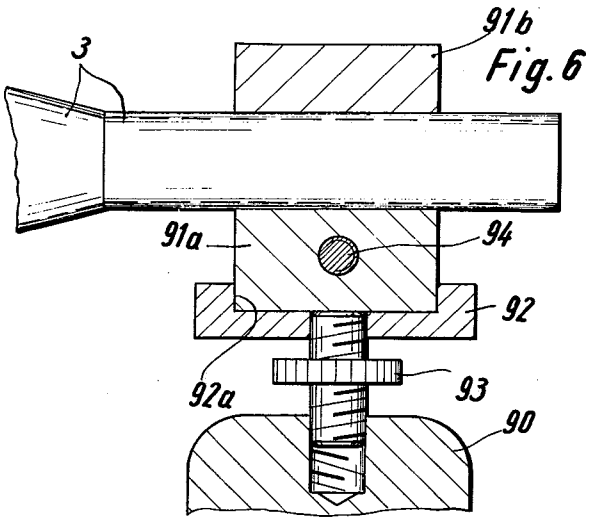
FIG. 6 is a sectional view as seen in the direction of arrows from the line VI—VI of FIG. 5.

Referring first to FIGS. 1 to 4, there is shown a portion of a screen printing machine which comprises a rotary horizontal cylindrical screen or stencil 1. The lowermost portion of the external surface of the stencil 1 contacts a web 2 of fabric or other material to be printed. The fabric is moved in the direction indicated by arrow and is preferably advanced together with a suitable back cloth, not shown, which travels above a stationary counter-pressure beam G of the type disclosed, for example, in my copending application Ser. No. 479,911 filed June 19, 1974. The cylindrical stencil 1 can be replaced by an endless band-like stencil which is trained over at least two rolls, preferably over at least three rolls at least one of which is driven and at least one of which constitutes a tensioning means for the band.

The stationary support means for the pivotable holder 7 of a blade-like elastically deformable squeegee 8 comprises a horizontal fluid-supplying pipe or header 3 and a carrier 4 which is welded or otherwise rigidly secured to the pipe 3 in the interior of the stencil 1.

The pipe 3 can supply into the stencil 1 a highly viscous (pasty) or readily flowable liquid substance, e.g., an adhesive or a coloring agent. As shown in FIG. 4, the top portion of the pipe 3 has at least one port 3*a* which discharges the liquid against the internal surface of a baffle-like deflector 3*b*.

The carrier 4 is located at a level below the tube 3 and includes a substantially U-shaped wall or portion 42 having two downwardly extending legs and a concave underside serving as an abutment for the adjacent portion of an elongated tubular cushion or biasing means 5 which is filled with a compressed gas (e.g., air) and serves to urge the holder 7 downwardly, as viewed in FIG. 4, whereby the edge portion 8A of the blade-like squeegee 8 bears against the internal surface of the stencil 1 with a force which is porportional to the pressure of gaseous fluid in the cushion 5. The means for holding the cushion 5 against movement out of the socket which is defined by the portion 42 of the carrier 4 includes two abutments or shoulders 40 which extend toward each other at the lower ends of the respective legs and may constitute horizontal ledges forming integral or separable parts of the carrier. If desired, the upper sides of the shoulders 40 can be configurated to conform exactly to the shape of the adjacent portion of the external surface of the cushion 5. The cushion 5 extends along the full length of the beam G and its ends are sealed save for the ports which serve for admission or evacuation of compressed gas. The upper portion of the external surface of the cushion 5 can be glued or otherwise bonded to the concave surface of the carrier portion 42.

The carrier 4 further comprises several (e.g., two) laterally extending brackets or fins 41 which support a pintle 6 extending in parallelism with the axis of the stencil 1 and with the edge portion 8A of the squeegee 8. The pintle 6 may constitute a one-piece shaft or it may consist of two or more discrete coaxial sections each of which is preferably mounted in at least two brackets 41. It will be noted that the pintle 6 is located behind the squeegee 8, as considered in the direction of rotation of the stencil 1 (see the arrow D in FIG. 4).

Figure 9:
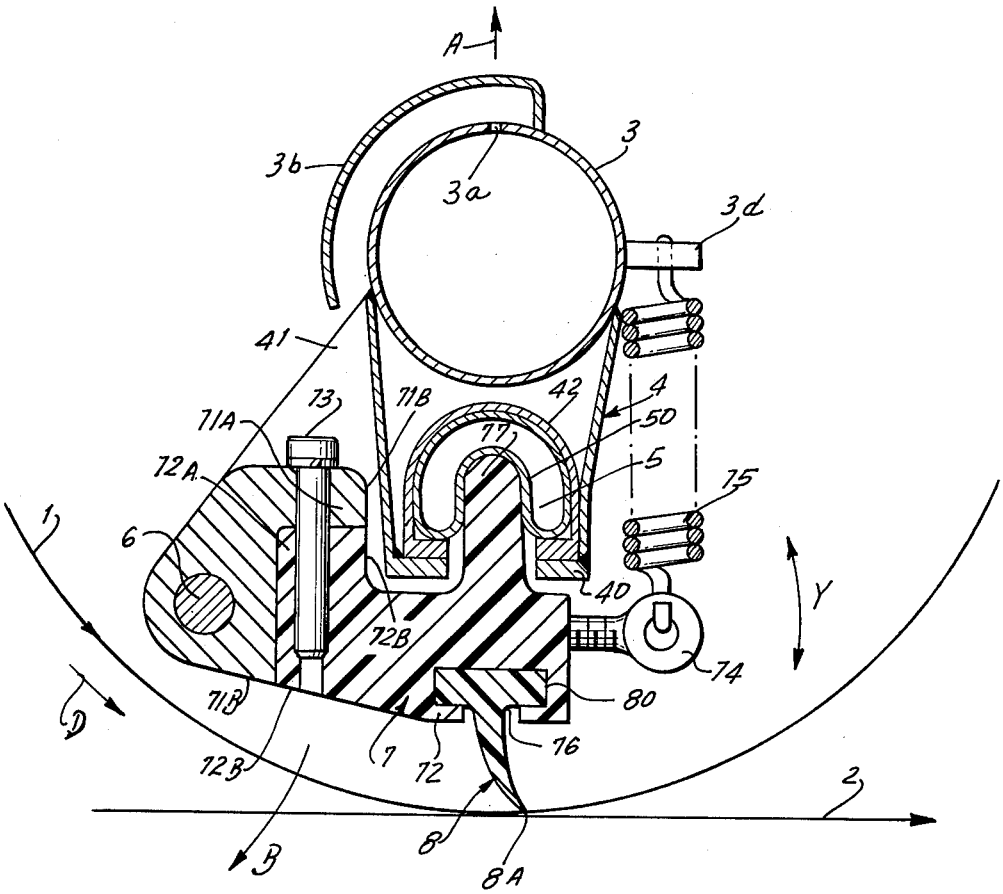
FIG. 9 is a view similar to FIG. 4, but showing another somewhat modified embodiment.

The holder 7 for the squeegee 8 is pivotable about or with the pintle 6 and comprises a first portion 71 which is directly mounted on the pintle 6, a second portion 72 which supports the squeegee 8, and screws, bolts or analogous fasteners 73 for rigidly but separably connecting the portion 72 to the portion 71. FIG. 4 shows that the portions 71, 72 have complementary (mating) parts 71A, 72A which are in face-to-face abutment with each other and that the parts 71A, 72A have aligned external surfaces 71B, 72B which merge into each other to insure a smooth transition from the portion 71 into the portion 72 or vice versa. If desired, the one-piece portion 71 of the holder 7 can be replaced by two or more discrete elements which are spaced apart from each other, as considered in the axial direction of the pintle 6, and each of which is separably attached to the portion 72 (e.g. by fasteners 73). For example, the portion 71 of the holder 7 may comprise a discrete element for each bracket 41 of the carrier 4. The portion 72 of or the entire holder 7 may consist of a suitable synthetic plastic material, e.g. nylon. Such a possibility is shown in FIG. 9 which resembles FIG. 4 but shows at least the portion 72 may be of synthetic plastic material. The arrow Y indicates that the holder 7 can move relative to the carrier 4 by reciprocating.

Those parts of the portion 72 of the holder 7 which are remote from the pintle 6 carry one or more eyelets 74 for the lower end portions of vertical helical springs 75 which serve to bias the holder and the squeegee 8 counterclockwise, as viewed in FIG. 4, i.e., to urge the edge portion 8A away from the internal surface of the stencil 1. The bias of the springs 75 is preferably selected in such a way that they counteract the combined weight of the holder 7 and squeegee 8 so that the force with which the edge portion 8A bears against the stencil 1 is determined exclusively or practically exclusively by the pressure of gaseous fluid which is confined in the deformable but non-stretchable cushion 5. The eyelets 74 may be formed with externally threaded shanks which extend into tapped bores of the portion 72. The upper end portions of the spring 75 are attached to retainers 3*d* on the pipe 3; however, it is also possible to provide such retainers on the upper portion of the carrier 4.

The cross section of the squeegee 8 is T-shaped and the head 80 of this squeegee extends into a mating groove 76 provided in the underside of the holder portion 72. However, it is equally within the purview of the invention to employ a rod-like cylindrical squeegee 8*a* of the type shown in FIG. 4*a;* the major portion of the squeegee 8*a* is received in a complementary elongated socket 76*a* provided in a modified holder portion 72*a.*

Referring again to FIGS. 1 to 4, the portion 72 of the holder 7 comprises an upwardly projecting elongated extension or rail 77 which is bounded by a rounded (substantially semi-cylindrical) surface and bears against the underside of the deformable cushion 5 so as to impart to the cushion a kidney-shaped cross-sectional outline. The axis of the pintle 6 and the axes of the shanks of eyelets 74 are preferably located in a common horizontal plane which extends substantially midway between the cushion 5 and the squeegee 8. Also, the extension 77 and the squeegee 8 preferably have a common vertical symmetry plane which includes the axis of the tube 3 and is normal to the plane of the web 2 in the region where the web is contacted by the external surface of the stencil 1. Since the squeegee 8 is located substantially or exactly midway between the pintle 6 and the springs 75, its downwardly extending part can be located in a vertical plane when the edge portion 8A is not deflected by the internal surface of the stencil 1; this insures that the extent of deflection of the edge portion 8A from such vertical plane can be regulated by the simple expedient of changing the pressure of fluid in the cushion 5. Such mounting of the holder 7 further insures that the squeegee 8 is not likely to vibrate, oscillate or perform other stray movements when the screen printing machine is in use. The rounded upper surface of the extension 77 reduces the likelihood of damage to the cushion 5 and enables the latter to lie flush against the concave surface of the U-shaped portion 42 of the carrier 4. This insures that the upper part of the external surface of the cushion 5 is not likely to shift relative to the concave surface of the portion 42 when the extension 77 moves up or down in response to changes in the pressure of fluid which is entrapped in the interior of the cushion. Of course, the cushion 5 cannot move relative to the portion 42 if it is glued or otherwise bonded to the carrier 4.

When the cushion 5 receives additional compressed gas, it tends to reduce the depth of depression which is caused by the extension 77, i.e., the holder 7 is urged to pivot counterclockwise, as viewed in FIG. 4. If a pivoting of the holder 7 takes place, the extension 77 is likely to roll rather than slide along the adjacent portion of the external surface of the cushion 5. This also reduces the likelihood of the generation of stresses which would tend to expand the cushion.

Figure 8:
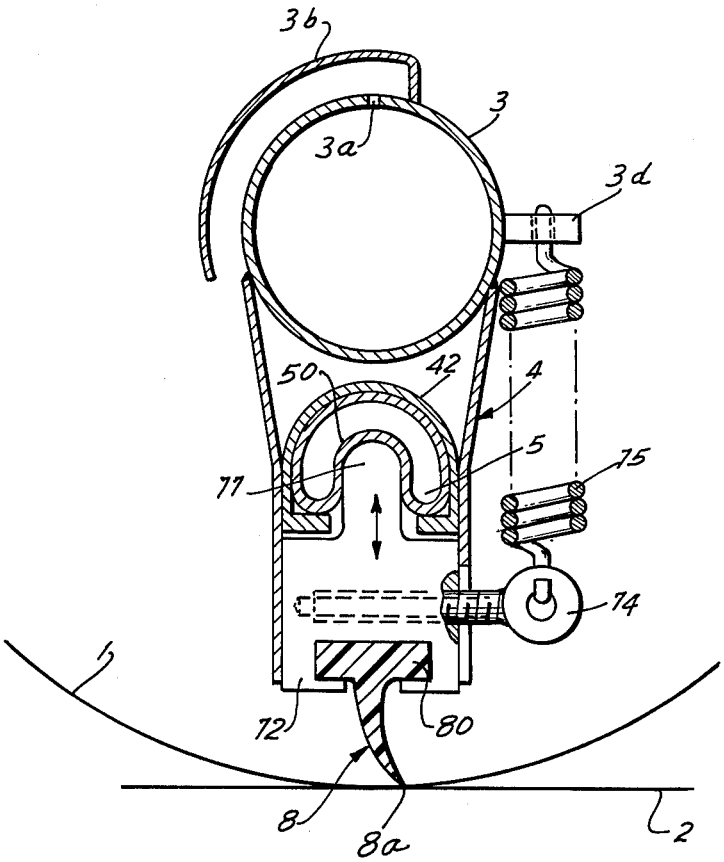
FIG. 8 is a view analogous to FIG. 4, but showing a modified embodiment.

The cushion 5 can be used with equal advantage in a screen printing machine wherein the holder for the squeegee is reciprocable (rather than pivotable) with respect to the support means. Thus, the pintle 6 can be replaced by vertical ways for the portion 72 of the holder 7 so that the latter can move substantially radially of the stencil 1 (toward or away from the pipe 3), depending on the nature of changes in pressure of the gaseous fluid which is confined in the cushion 5, as shown by way of example in the self-explanatory FIG. 8. All that counts is to employ a deformable but non-elastic cushion which effects movements of the holder and squeegee toward or away from the internal surface of the stencil substantially or exactly opposite the locus where the external surface of the stencil contacts the web, and to preferably employ a holder which is pivotable or reciprocable and comprises an extension which bears against the adjacent portion of the cushion. As mentioned above, it is desirable to place the cushion into a recess or socket of the carrier 4 (see the U-shaped portion 42) to thus insure that the respective portion of the cushion cannot slide relative to the carrier.

The cushion 5 may comprise a deformable elastic hose which contains one or more layers 51 of reinforcing material (see FIG. 3*a*). The layer or layers 51 may consist of a textile material, of metallic (e.g., steel) threads or wires, or any other material which is not elastic (i.e., which does not expand or contract in response to changes in the pressure of fluid in the interior of the cushion). If the hose of the cushion 5 is deformable but non-stretchable, the reinforcing layer or layers 51 may consist of an elastomeric material. The reinforcing layer or layers 51 in the hose of the cushion 5 contribute to longer useful life and allow for a more accurate regulation of the pressure with which the squeegee bears against the stencil. Also, the extent of deformation of the cushion by the extension 77 is reproducible with a high degree of accuracy which could not be achieved if the wall of the cushion were free to expand or contract in response to changes in the pressure of entrapped gaseous fluid. As mentioned above, such changes in the pressure of fluid will cause a corresponding change in the extent to which the extension 77 penetrates into the portion 42 of the carrier 4.

It has been found that a cushion of the just described type can properly bias a squeegee in a screen printing machine wherein the width of the material to be printed or otherwise treated by contact with the stencil is in the range of up to and even in excess of 5 meters.

It is also possible to employ a cushion which, when not deformed, need not have the shape of a hose with a circular cross-sectional profile as shown in FIG. 3*a*. For example, the portion 42 of the carrier may have an oval or even polygonal outline so that the cushion assumes a complementary shape when it is inserted into the carrier and receives compressed gaseous fluid while being simultaneously engaged by the extension of the holder. It is desirable, however, to employ a cushion which may consist in part of elastomeric material but also includes one or more layers of non-elastic material (or vice versa) to thus permit a deformation but to prevent expansion or contraction of the cushion in actual use.

If the attendants desire to clean the squeegee 8, the lower end portions of the springs 75 are detached from the respective eyelets 74, the pipe 3 is moved upwardly together with the support 4 (arrow A in FIG. 4) to raise the pintle 6, and the holder 7 is pivoted clockwise (arrow B in FIG. 4) so that the edge portion 8A of the squeegee faces upwardly and the entire squeegee (save for the head 80) is readily accessible.

If the squeegee 8 is to be replaced with a fresh or differently configurated squeegee, the fasteners 73 are loosened or removed so that the portion 72 of the holder 7 becomes separated from the portion 71, and the parts 72, 8 are then withdrawn through the one or the other end of the stencil 1. It is also possible to remove the squeegee 8 by simply pushing it lengthwise of the portion 72 while the latter remains attached to the portion 71, and to thereupon introduce the head 80 of a fresh squeegee into the socket 76 in a similar way.

Figure 4A:
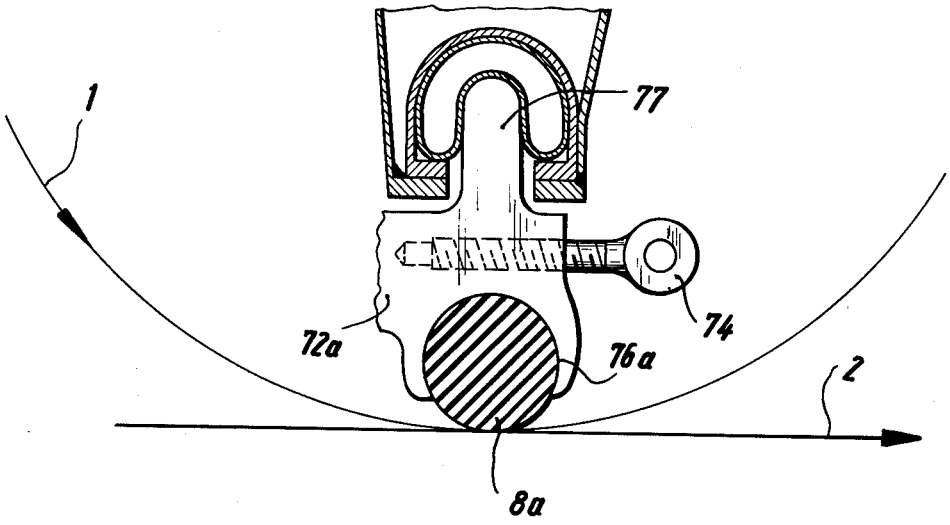
FIG. 4*a* is a similar view of a detail in a modified screen printing machine.

If the machine comprises two or more stencils, each stencil, a single stencil, or selected stencils may receive a squeegee which is mounted in a manner as shown for the squeegee 8 or 8*a* of FIGS. 1–4 of FIG. 4*a*.

An important advantage of a pintle which is located ahead of the locus where the squeegee engages the internal surface of the stencil, as considered in the direction of movement of the stencil, is that the bearings (brackets 41) for the pintle can take up substantial stresses and that such stresses can be distributed along the full length of the stencil, depending on the number and distribution of the brackets 41. Consequently, and due to the provision of biasing means 75, the force with which the squeegee is urged against the internal surface of the stencil can be reduced to a minimum so that the machine can employ squeegees which consist of thin steel sheet stock, of an elastomeric (rubber-like) material, and/or a combination of both. The biasing means 75 which counteracts the weight of the holder 7 or 7*a* and squeegee 8 or 8*a* insures that the friction between the internal surface of the stencil and the squeegee can be reduced to a very low value so that the locus of contact between the stencil and the squeegee changes very little or not at all that the vibration of squeegee is negligible. The bias of the springs 75 can be selected with a view to counteract only the combined weight of the squeegee and holder 7 or 7*a;* thus, when the pressure of fluid in the cushion 5 is reduced, the squeegee can be lifted off or maintained in negligible frictional engagement with the stencil.

Figures 2, 3:
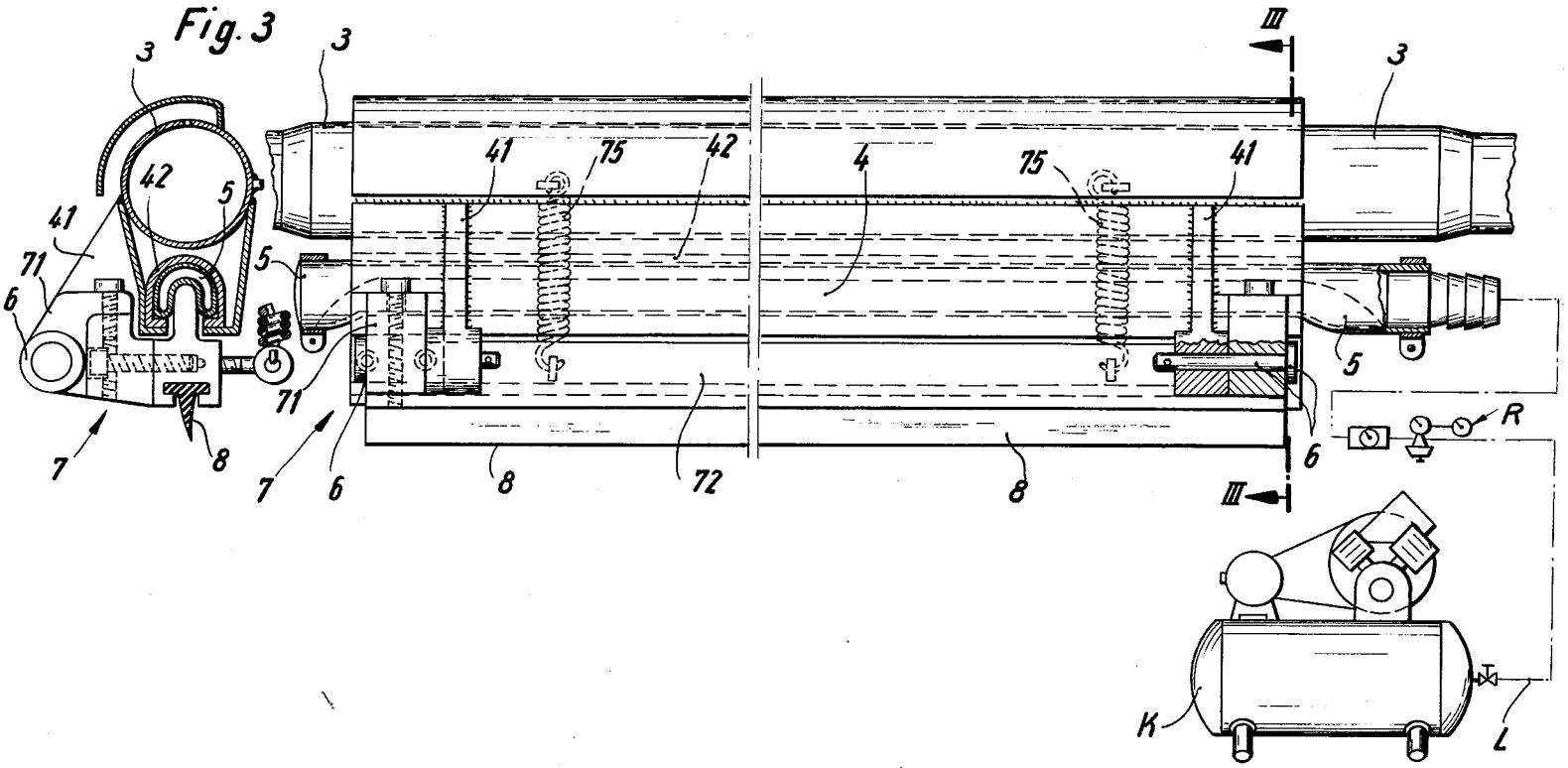
FIG. 2 is an enlarged longitudinal vertical sectional view of the structure shown in the central portion of FIG. 1.
FIG. 3 is a transverse vertical sectional view as seen in the direction of arrows from the line III—III in FIG. 2.

FIG. 2 further shows a compressor K which can supply to the cushion 5 compressed air through a conduit L. The pressure of fluid in the cushion 5 can be regulated by a control system R including a throttle valve, a shutoff valve and/or others, and one or more gauges.

FIG. 1 shows two pumps P, driven by motors F, which supply liquid to the respective ends of the pipe 3 by way of conduits S.

Figure 5:
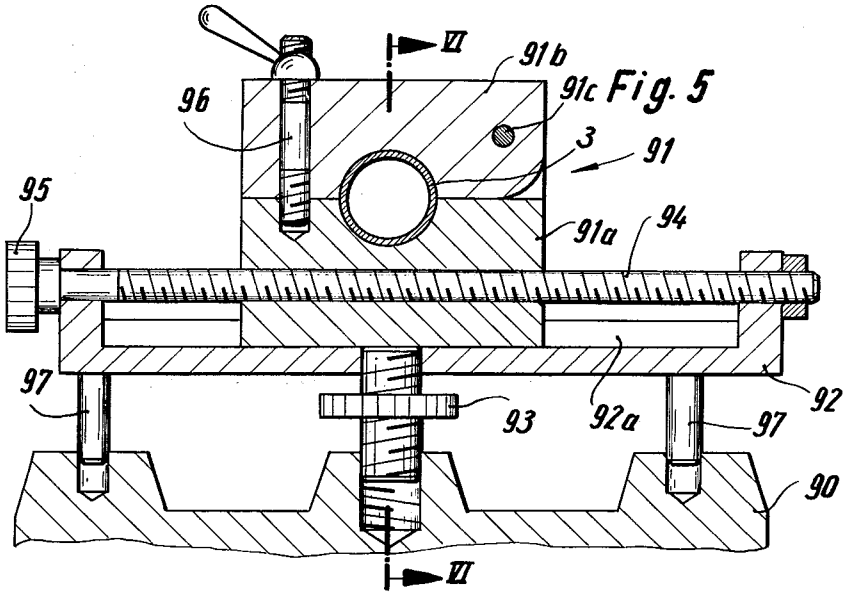
FIG. 5 is an enlarged vertical sectional view as seen in the direction of arrows from the line V—V of FIG. 1.

The end portions of the pipe 3 extend beyond the bearings or heads 10 for the stencil 1 and are mounted in bearing members 91 one of which is shown in FIGS. 5 and 6. Each bearing member 91 has a lower portion of jaw 91*a* and an upper portion or jaw 91*b* which is pivotable at 91*c*. A threaded locking member 96 can be used to hold the portion 91*b* against pivotal movement on the pin 91*c*. The lower portion 91*a* is provided with a tapped through bore receiving a portion of a feed screw 94 having a handgrip portion 95. By rotating the feed screw 94, an attendant can move the bearing member 91 transversely of the stencil 1 in ways 92*a* provided in a base 92. The base 92 is movable up and down with respect to an arm 90 of the machine frame 9 by rotating a vertical screw 93 which meshes with the arm 90 and extends into a socket of the base 92 below the bearing member 91. The reference characters 97 denote guide pins which are secured to the base 92 and extend into vertical holes of the arm 90. The screw 93 allows for an accurate adjustment of the level of the corresponding end portion of the pipe 3, carrier 4, holder 7 and squeegee 8.

Figure 7:
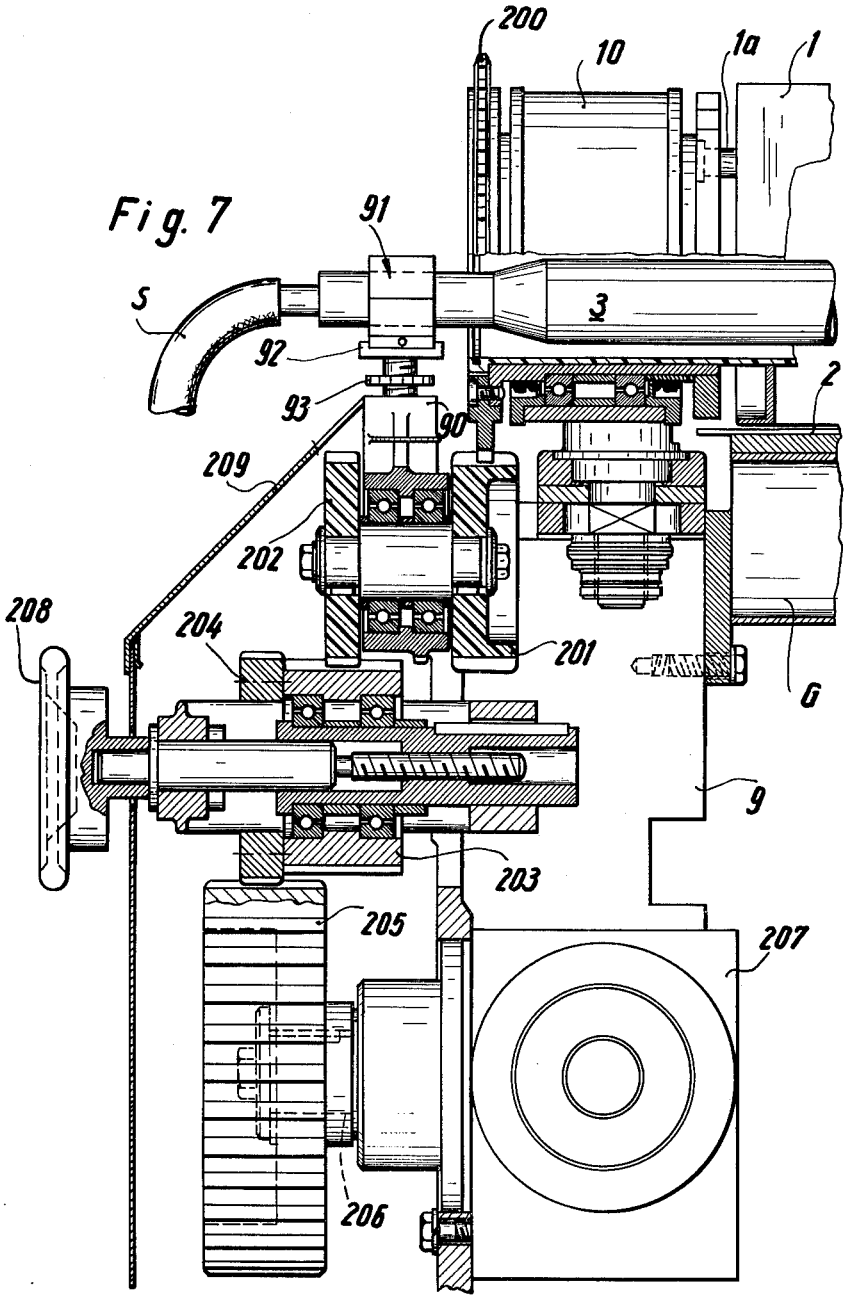
FIG. 7 is an enlarged partly elevational and partly vertical sectional view of the drive means for the stencil.

FIG. 7 illustrates the construction of drive means for rotating the stencil 1. The illustrated end portion of the stencil 1 is connected with an annular holder 1*a* which is rotatable in the respective head 10 and carries a gear 200 forming part of a gear train which further includes the gears 201, 202, 203, 204 and 205. The gear 205 is mounted on the output shaft 206 of a prime mover 207, e.g., a hydraulically operated motor. A similar train of gears can be provided to drive the other end of the stencil 1. The hand wheel 208 of FIG. 7 can be turned to move the hub on which gears 203, 204 are mounted, in axial direction so as to shift the gear 203 into and out of mesh with the gear 202 or the gear 204 into or out of mesh with the gear 205. A shield 209 is provided to confine the gear train so as to reduce the likelihood of injury to attendants.

Without further analysis, the foregoing will so fully reveal the gist of the present invention that others can by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. In a screen printing machine, a combination comprising an elongated liquid-permeable stencil having endless internal and external surfaces; means for moving said stencil so as to engage successive increments of a web of material to be treated along a region of contact which extends lengthwise of said stencil; a movable holder having one side facing towards said region of contact and another side which faces away from said region of contact and is provided with a bar-shaped extension extending lengthwise of said stencil, stationary support means for supporting said holder and having a portion located in the interior of said stencil; a squeegee mounted on said holder at said one side thereof, said holder comprising a first portion which is pivoted to said support means; a second portion which supports said squeegee, and fastener means separably securing said second portion to said first portion, and said holder being movable by pivoting about an axis which is substantially parallel to the longitudinal extension of said stencil and is located ahead of said squeegee, as considered in the direction of movement of said stencil; and biasing means interposed between said support means and said holder to urge said squeegee against said internal surface, including an elongated tubular gas-filled cushion which straddles said bar-shaped extension and is inwardly deformed by the same so that variations in the depths of the deformation of said cushion result in corresponding variations in the biasing action.

2. The combination of claim 1, wherein said extension is provided on said second portion of said holder.

* * * * *